US008919527B2

(12) United States Patent
Heinemann et al.

(10) Patent No.: US 8,919,527 B2
(45) Date of Patent: Dec. 30, 2014

(54) CONVEYING EQUIPMENT FOR PERSONS

(75) Inventors: Gerd Heinemann, Bad Harzburg (DE); Thomas Novacek, Schwechat (AT); Michael Matheisl, Vösendorf (AT); David Krampl, Vienna (AT)

(73) Assignee: Inventio AG, Hergiswil (CH)

( * ) Notice: Subject to any disclaimer, the term of this patent is extended or adjusted under 35 U.S.C. 154(b) by 662 days.

(21) Appl. No.: 13/241,504

(22) Filed: Sep. 23, 2011

(65) Prior Publication Data

US 2012/0073934 A1 Mar. 29, 2012

(30) Foreign Application Priority Data

Sep. 24, 2010 (EP) ..... 10179457

(51) Int. Cl.
*B66B 23/00* (2006.01)
*B66B 23/14* (2006.01)

(52) U.S. Cl.
CPC ..... *B66B 23/00* (2013.01); *B66B 23/14* (2013.01)
USPC ..... 198/321

(58) Field of Classification Search
USPC ..... 198/321, 326, 327, 332
See application file for complete search history.

(56) References Cited

U.S. PATENT DOCUMENTS

| | | | | | |
|---|---|---|---|---|---|
| 3,682,289 | A * | 8/1972 | Kraft | ..... | 198/332 |
| 4,484,674 | A * | 11/1984 | Lunardi et al. | ..... | 198/332 |
| 7,431,139 | B2 * | 10/2008 | Streibig et al. | ..... | 198/327 |
| 7,703,594 | B2 | 4/2010 | Stein | | |
| 2003/0000800 | A1 * | 1/2003 | Krampl | ..... | 198/321 |

FOREIGN PATENT DOCUMENTS

| | | | | | |
|---|---|---|---|---|---|
| EP | 1321424 | A1 | 6/2003 | | |
| EP | 1142819 | B1 | 11/2008 | | |
| FR | 2269468 | A1 | 11/1975 | | |
| GB | 2121748 | A | 1/1984 | | |
| JP | 53140789 | A * | 12/1978 | ..... | 198/321 |
| JP | 2003335486 | A | 11/2003 | | |
| WO | 02/092491 | A1 | 11/2002 | | |

* cited by examiner

*Primary Examiner* — Mark A Deuble
(74) *Attorney, Agent, or Firm* — Fraser Clemens Martin & Miller LLC; William J. Clemens

(57) ABSTRACT

Conveying equipment for persons includes sheet metal parts, stiffeners, H-frames and travel tracks, which together with respect to statics, load-bearing capability and stiffness can be used as a framework support construction.

15 Claims, 5 Drawing Sheets

CONVEYING EQUIPMENT FOR PERSONS

CROSS-REFERENCE TO RELATED APPLICATION

This application claims priority to European Patent Application No. 10179457.6, filed Sep. 24, 2010, which is incorporated herein by reference.

FIELD

The disclosure relates to conveying equipment for persons.

BACKGROUND

A support construction for an escalator or a moving walkway has become known from the specification EP 1 321 424 A1. The support construction comprises at least one framework element which is constructed integrally and as an areal, unprofiled, cut plate. The framework element can, for example, be made from sheet metal. The side walls constructed from the framework elements have substantially as much load-bearing material in the form of webs or girders as is necessary for exercise of the supporting function. Reinforcements in the form of angle profile members are provided in the upper region of the support walls. Moreover, the support walls are connected by means of transverse frames consisting of cross-connectors and ribs.

An escalator has become known from the specification EP 1 142 819 B1, in which the steps are supported in horizontal direction in the forward run at the balustrade base and in the return run at the travel track profile section. A respective lubricated rolling ball or a guide roller, for example, is provided for each step and in the forward run rolls on the base metal plate stiffened by means of profile rails and in the return run on the travel track profile section side wall.

An escalator, the supporting walls of which are made from sheet metal parts, has become known from the specification JP 2003 335486 A. Stiffeners in the form of angle profile members are provided in the upper and lower region of the supporting walls. In addition, the supporting walls are stiffened by means of ribs and connected by means of cross members.

A moving walkway has become known from the specification GB 2 121 748, in which side walls made from sheet metal parts support the travel tracks for the tread plate rollers. Balustrade supports support the balustrade and reinforce the side walls. A framework stiffens the support walls of the moving walkway.

SUMMARY

In at least some embodiments of the disclosed technologies, the support construction can be constructed with relatively few parts, which are simple to produce, and thus the production costs can be kept low. Moreover, specific components at the same time can fulfill several functions such as, for example, stiffening, guiding, covering and protecting. The component for stiffening the side wall can at the same time form the base plate in the conveyor element region, and it can also provide horizontal guidance of the conveyor elements in the forward run. The travel tracks for the conveyor element rollers and chain rollers can serve at the same time for stiffening the side wall. The component for stiffening the side wall at the lower end can also serve for guidance in the horizontal direction of the conveyor elements in the return run.

With the multi-functional components and with the arrangement of the ribs at the outer side of the side wall, the conveying equipment for persons can be of significantly more slender construction than hitherto. In at least some embodiments, conveying equipment for persons, which is of slender construction in width, is capable of transport more efficiently, is more economic, can be assembled more simply, can be modified more easily, is simpler to install and demands less building space, less installation width and less floor area. In further embodiments, conveying equipment for persons, which is of slender construction, can also be installed, for example in the case of modernization, in existing support structures or frameworks.

BRIEF DESCRIPTION OF THE DRAWINGS

The present disclosure is explained in more detail by way of the following detailed description and the accompanying figures, in which.

DETAILED DESCRIPTION

An exemplifying embodiment of the conveying equipment for persons with conveyor elements, which are combined to form an endless belt, on the basis of an escalator with steps is explained in the following. The explanations also apply in the same sense to a moving walkway with tread plates. In the case of an escalator a conveyor element is a step and in the case of a moving walkway a conveyor element is a tread plate.

Figure 1:
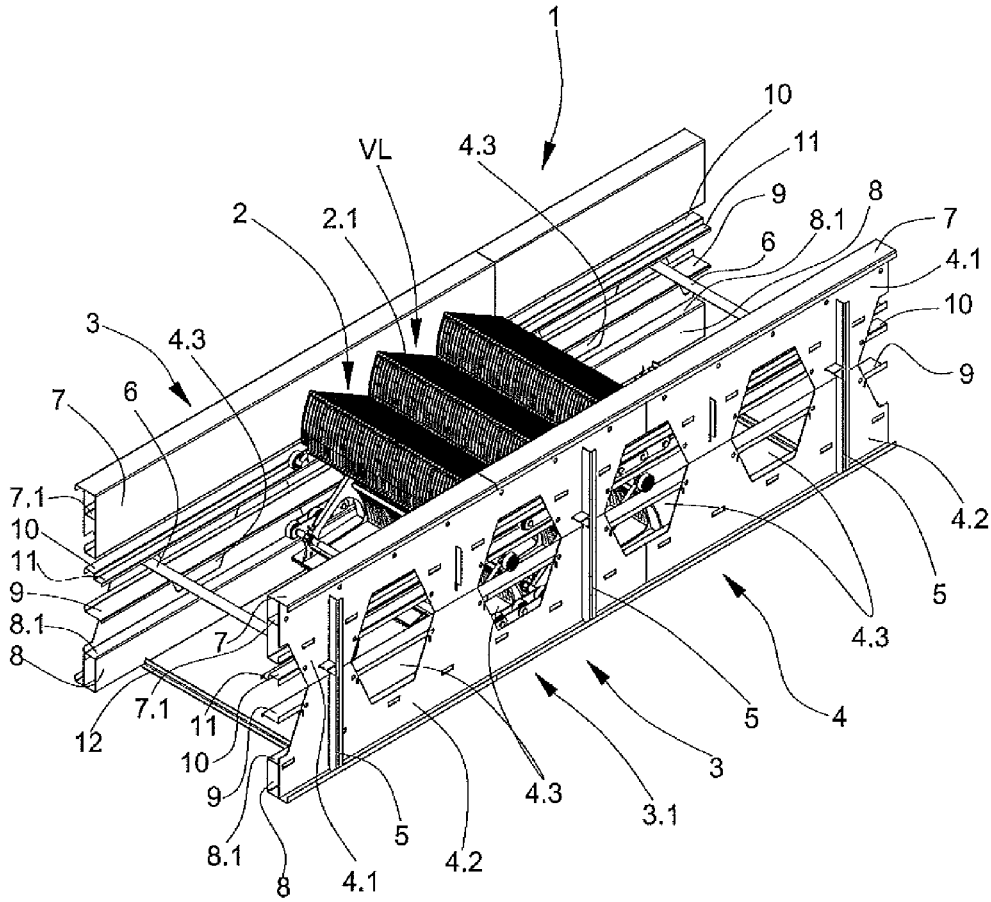
FIG. 1 shows a schematic three-dimensional view of an exemplary embodiment of conveying equipment for persons, which is made from sheet metal parts.
Figure 1A:
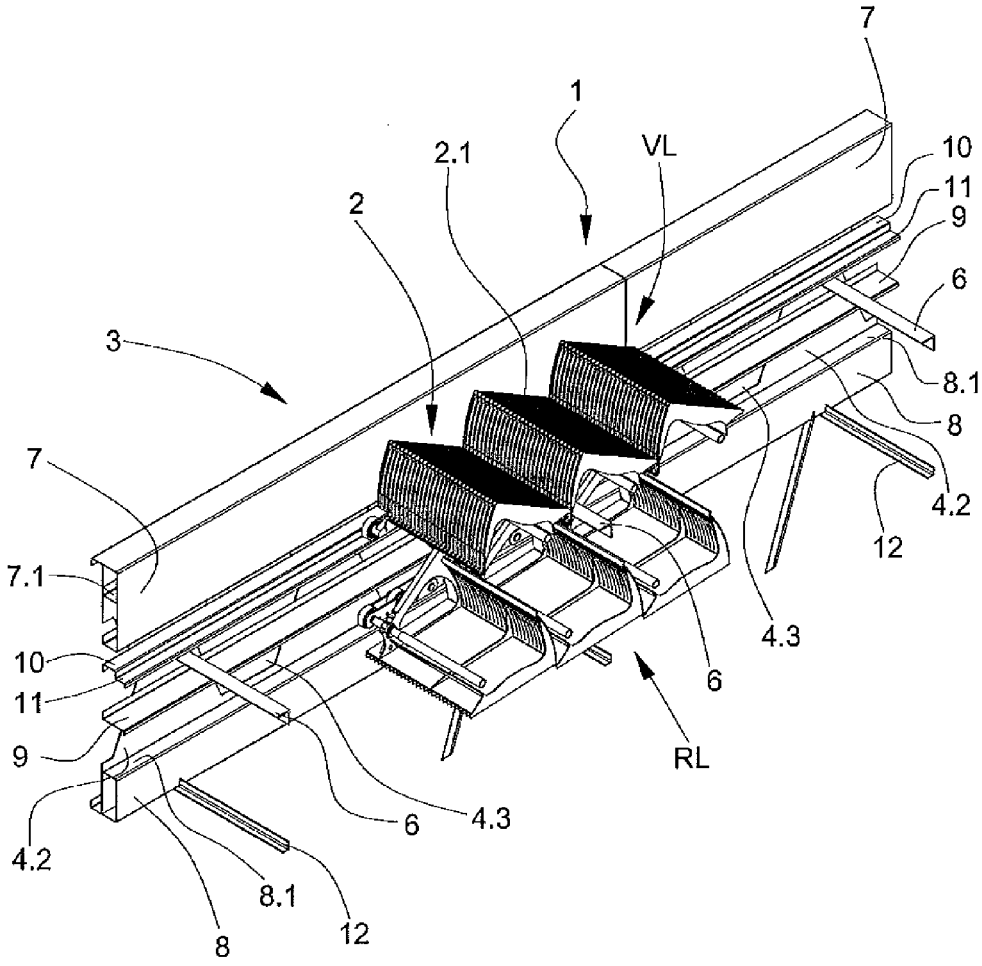
FIG. 1*a* shows an exemplary embodiment of a longitudinal section through the conveying equipment for persons of FIG. 1.
Figure 2:
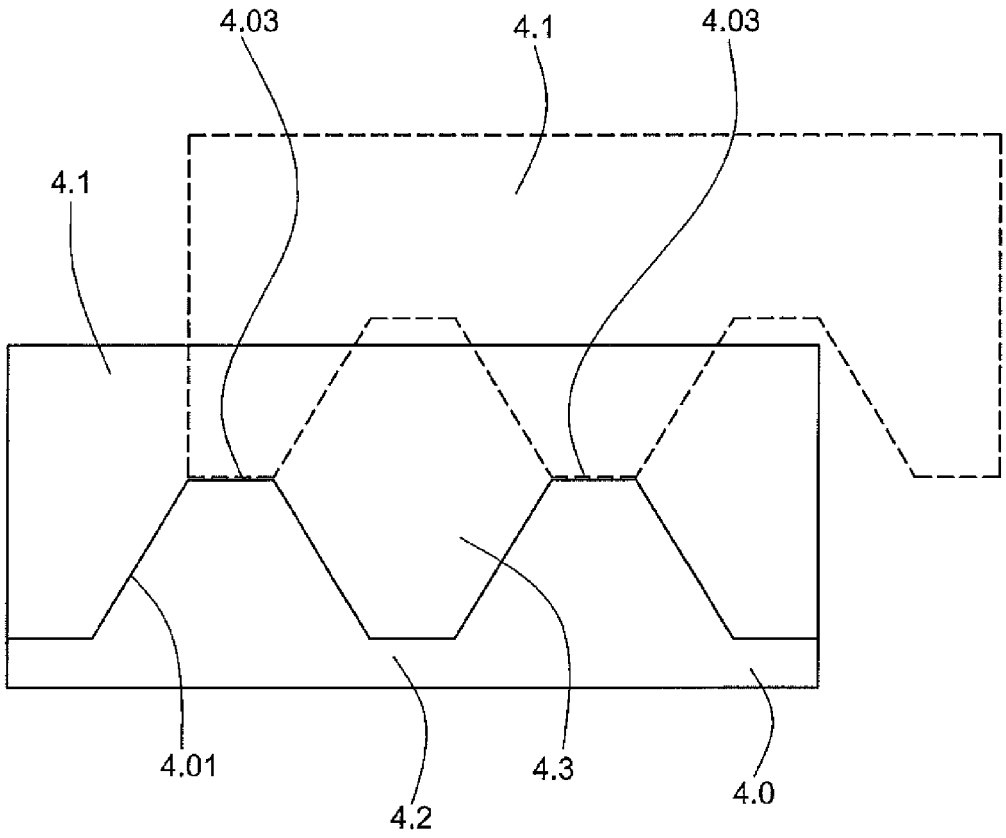
FIG. 2 shows an exemplary embodiment of a production of sheet metal part halves.

FIG. 1 and FIG. 1*a* schematically show an exemplifying embodiment of an escalator 1 with a step belt 2 with steps 2.1 for the transport of persons and/or objects in the forward run. The endless step belt 2 returns in the return run. Not illustrated is the respective balustrade, which is provided for each side wall 3, with handrail. A side wall 3 substantially consists of at least one sheet metal part 4 which contributes to the longitudinal stiffness of the escalator 1 and usually consists of an upper sheet metal part half 4.1 and a lower sheet metal part half 4.2. The sheet metal part halves 4.1, 4.2 are made from an unprofiled, planar sheet metal panel such as described in connection with FIG. 2. With the mode of construction of the sheet metal part 4 according to FIG. 2, no parts, which are not needed for the statics of the escalator 1, of the sheet metal part halves 4.1, 4.2 have to be removed. Resulting from the separating line according to FIG. 2 are, for example, hexagonal cut-outs 4.3 which contribute to weight-saving and to efficient utilization of material. In some embodiments, two adjacent metal part halves 4.1, 4.2 are usually assembled together at the abutting side, for example, welded together or glued together or connected together by means of clamps.

To stiffen a sheet metal part, at least one rib 5, which is connected with a center cross member 6, is provided to extend approximately over the height of the sheet metal part 4. The rib 5 forms, together with the associated rib of the opposite side wall and the centre cross member 6, an 'H', termed H-frame in the following, which primarily ensures the lateral stiffness of the escalator 1. With the ribs 5 arranged at the outer side 3.1 of the side wall 3, in at least some embodiments the escalator is constructed to be more slender and with less external width than an escalator with a conventional supporting construction.

Figure 4:
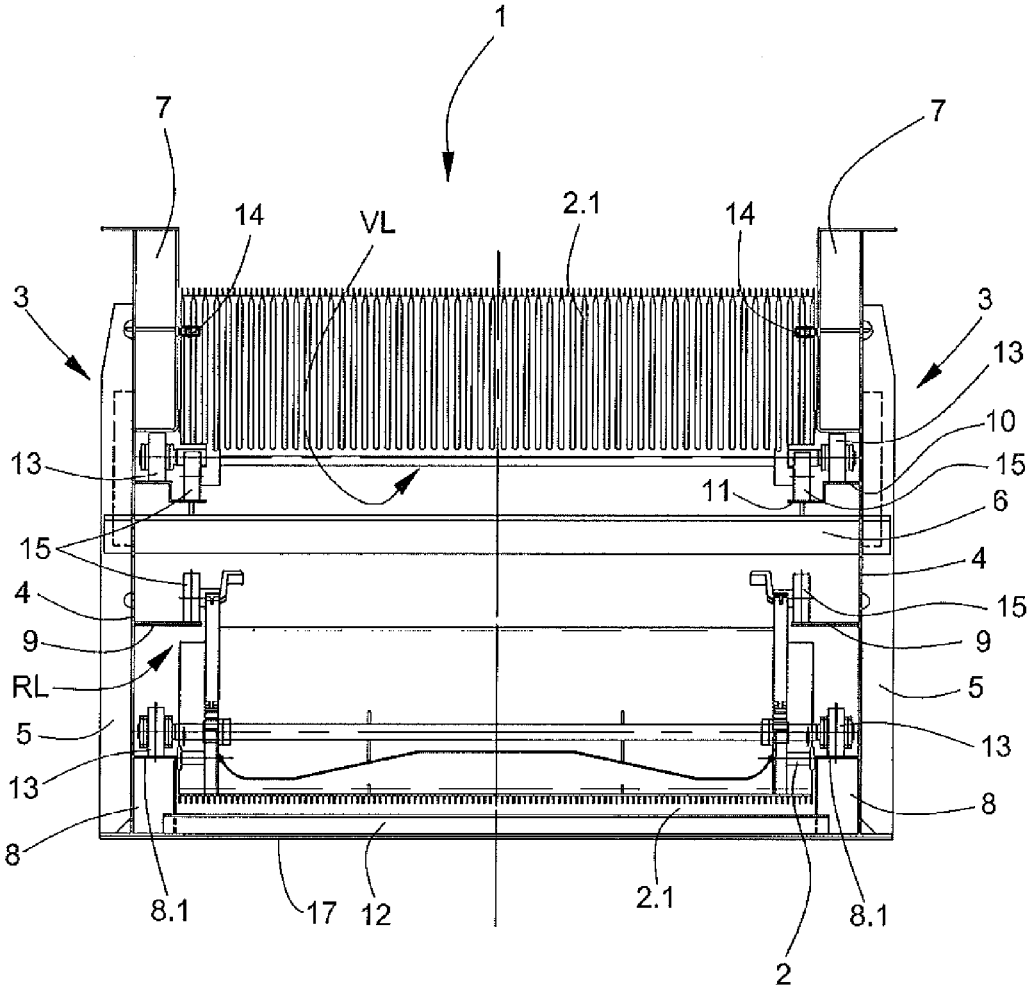
FIG. 4 shows an exemplary embodiment of a cross-section through the conveying equipment for persons according to FIG. 1 and FIG. 1*a*.

For further stiffening, for example stiffening in bending, of the escalator 1 a box-like upper stiffener 7 with stiffening web 7.1 and a box-like lower stiffener 8 are provided for each side wall 3, which stiffeners together with the sheet metal part 4 form along the entire length of the escalator a cavity offering space for electrical lines, signal lines, lines for fire protection medium, etc. The upper stiffener 7 fulfils, apart from stiffening of the escalator 1, a further function; it forms at the same time a base of the balustrade (not illustrated) and guides the steps 2.1 in horizontal transverse direction. As illustrated in FIG. 4, the upper stiffener 7 also serves as a support and vertical boundary for chain rollers.

The lower stiffener 8 of one side wall 3 is connected by means of at least one lower cross member 12 with the lower stiffener of the other side wall 3 and fulfills, apart from stiffening the escalator 1, a further function: it serves at the same time, together with a first travel track 9, as a second travel track 8.1 for the steps 2.1 in the return run and guides the steps 2.1 in horizontal transverse direction. The lower stiffener 8 is connected with the lower sheet metal part half 4.2 by means of welding or riveting or clamping or gluing.

A third travel track 10 and a fourth travel track 11, which are supported by the center cross member 6, are provided in the forward run for the steps 2.1. In some embodiments, the travel tracks 9, 10, 11 are correspondingly dimensioned so that they significantly contribute to stiffening of the escalator 1. The travel tracks 9, 10, 11 are connected with the lower sheet metal part half 4.2 and the upper sheet metal half 4.1 by means of welding or riveting or clamping or gluing.

FIG. 2 shows sheet metal part halves 4.1, 4.2, which have been produced from the sheet metal panel 4.2 and which, for example, correspond, for producing the side wall 3. The sheet metal panel 4.0 is divided into two halves along a parting line 4.01. One sheet metal part half, for example the upper sheet metal part half 4.1, is displaced as illustrated by dashed lines and connected at the abutting side 4.03 with the lower sheet metal part half 4.2. A cut-out 4.3, which is, for example, hexagonal, has been formed without loss of material.

Figure 3:
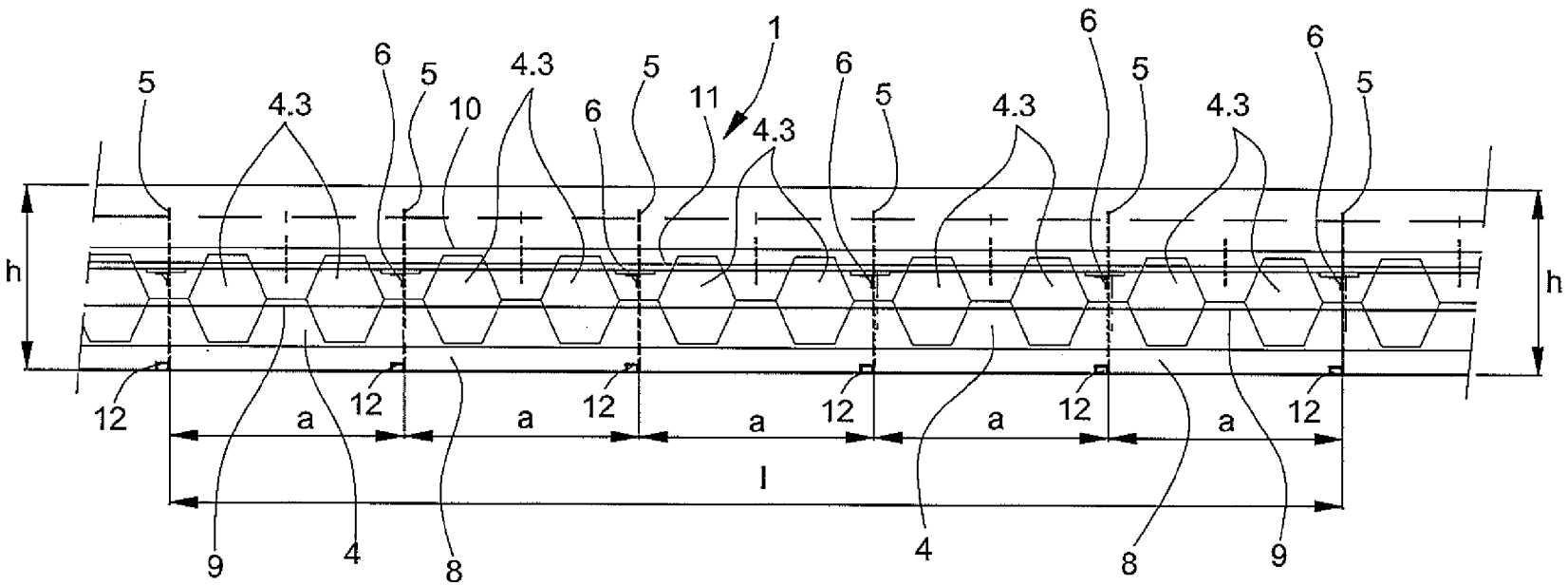
FIG. 3 shows an exemplary embodiment of sheet metal part halves produced from a sheet metal panel.

FIG. 3 shows sheet metal part halves which are produced from a sheet metal panel and form cut-outs 4.3. The sheet metal panel 4.1 has, for example, a length of I=6,000 millimeters, wherein a rib 5, a center cross member 6 and a lower cross member 12 are provided at a spacing of, for example, 1,200 millimeters. Two cut-outs 4.3 formed by the upper sheet metal part half 4.1 and the lower sheet metal part half 4.2 arise between two ribs 5. The sheet metal thickness of the sheet metal panel 4.0 is, for example, 3 millimeters to 6 millimeters and can vary in accordance with the respective span width of the escalator. In the case of a span width of approximately 16 meters, use is made of a sheet metal thickness of approximately 6 millimeters and in the case of span widths of approximately 10 meters, use is made of a sheet metal thickness of approximately 3 millimeters. The yield strength of the sheet metal panel plate lies between 235 $N/mm^2$ and 460 $N/mm^2$. In the illustrated exemplifying embodiment the lower sheet metal part half 4.2 together with the upper sheet metal part half has a height h of, for example 950 millimeters, approximately 80 millimeters less than an escalator of conventional mode of construction with a framework for comparable lifting heights and comparable transport capacities. The width of the escalator as measured over the ribs is, for example, approximately 1,250 millimeters, approximately 250 millimeters less than an escalator of conventional mode of construction with a framework for comparable lifting heights and comparable transport capacities.

FIG. 4 shows a section in transverse direction through the escalator according to FIG. 1 and FIG. 1*a*. The significant parts have already been described above. Chain rollers 13 run on the third travel track 10. The upper stiffener 7 prevents the chain rollers 13 in the forward run VL from lifting off their travel track 10. Moreover, a first lateral guide element 14 is shown for each step side, which guide element, as explained above, guides the step 2.1 in the forward run VL in horizontal transverse direction and in that case is supported at the upper stiffener 7. Step rollers 15 run in the forward run VL on the fourth travel track 11 and in the return run RL on the first travel track 9. The chain rollers 13 run in the return run RL on the second travel track 8.1, which is formed by the lower stiffener 8. Moreover, a second lateral guide element 16 is shown for each step side, which element, as mentioned above, guides the step 2.1 in the return run RL in horizontal transverse direction and is in that case supported at the lower support.

In some embodiments, each side wall 3 can also be of double-wall construction, wherein the double wall consists, for example, of parallel sheet metal parts 4 stiffened by ribs 5.

Sheet metal parts 4, stiffeners 7, 8, H-frames and travel tracks 9, 10, 11, 12 together replace, in terms of statics, load-bearing capability and stiffness, the previously used conventional framework.

A lower truss 17, which extends parallel to the side walls 3 and below the side walls 3 and which comprises tension elements for acceptance of tension forces in the escalator or in the moving walkway, can also be provided at the escalator or moving walkway.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. Conveying equipment for persons, comprising:

sheet metal parts, which form side walls and are stiffened by ribs;

an endless belt, which is movable between the side walls, and having conveyor elements, wherein the endless belt in a forward run conveys persons and/or goods and returns in a return run and wherein the conveyor elements of the endless belt comprise rollers, which roll on travel tracks; and stiffeners arranged over an entire length of the conveying equipment are provided in a region of the forward run and in a region of the return run at the side walls and the ribs are arranged at outer sides of the side walls, wherein the ribs of one of the side walls are connected with the ribs of another of the side walls by transverse center cross-members, wherein each of the ribs at the one side wall, an associated one of the ribs at the another side wall and one of the cross-members form an H-frame transverse to a direction of the runs.

2. The conveying equipment according to claim 1, the stiffeners being configured to increase a stiffness of the conveying equipment and to guide the conveyor elements in the forward run and the return run.

3. The conveying equipment according to claim 1, the stiffeners comprising an upper stiffener, the upper stiffener being configured as a balustrade base and being configured as a guide for the forward run of the conveyor elements in a horizontal transverse direction.

4. The conveying equipment according to claim 3, the upper stiffener being further configured as a guide for the forward run of the conveyer elements in a vertical direction.

5. The conveying equipment according to claim 1, the stiffeners comprising a lower stiffener, the lower stiffener forming at least one of the travel tracks for the rollers.

6. The conveying equipment according to claim 1, the sheet metal parts comprising respective upper and lower sheet metal part halves.

7. The conveying equipment according to claim 6, the respective upper and lower sheet metal part halves being produced from one or more sheet metal panels without loss of material.

8. The conveying equipment according to claim 6, the sheet metal parts comprising respective cut-outs, the respective cut-outs being defined by the respective upper and lower sheet metal part halves.

9. The conveying equipment according to claim 6, the ribs being arranged at the respective upper and lower sheet metal part halves.

10. The conveying equipment according to claim 1, the sheet metal parts being formed from one or more sheet metal panels, the sheet metal panels having a thickness and a yield strength depending on a span width of the conveying equipment.

11. The conveying equipment according to claim 10, the one or more sheet metal panels having a sheet thickness between 3 millimeters and 6 millimeters and a yield strength between 235 N/mm2 and 460 N/mm2.

12. The conveying equipment according to claim 1, the side walls comprising respective double walls, the respective double walls comprising the sheet metal parts.

13. The conveying equipment according to claim 1, further comprising a truss, the truss extending parallel to the side walls and underneath the side walls, the truss configured to accept tension forces in the conveying equipment.

14. Conveying equipment for persons, comprising:

sheet metal parts, which form first and second side walls and are stiffened by ribs;

an endless belt, which is movable between the side walls, and having conveyor elements, wherein the endless belt in a forward run conveys persons and/or goods and returns in a return run and wherein the conveyor elements of the endless belt comprise rollers, which roll on travel tracks; and stiffeners arranged over an entire length of the conveying equipment are provided in a region of the forward run and in a region of the return run at the side walls and the ribs are arranged at outer sides of the side walls, wherein each of the ribs of the first side wall is connected with associated one of the ribs of the second side walls by an associated transverse center cross-member to form an H-frame transverse to a direction of the runs.

15. A conveying device for persons, the device comprising:

sheet metal parts forming first and second side walls;

a plurality of ribs configured to stiffen the sheet metal parts;

conveyor elements, the conveyor elements comprising rollers configured to roll on travel tracks;

stiffeners arranged in a forward run region at the sidewalls and in a return run region at the sidewalls, the stiffeners comprising an upper stiffener, the upper stiffener being configured as a balustrade base and being configured as a guide for a forward run of the conveyor elements in a horizontal transverse direction;

an endless belt being movable between the first and second side walls using the conveyor elements; and one or more cross-members coupled to a portion of the plurality of ribs at the first side wall and a portion of the plurality of ribs at the second side wall.

* * * * *